US005144762A

United States Patent [19]

Robinson

[11] Patent Number: 5,144,762

[45] Date of Patent: Sep. 8, 1992

[54] WEAR INDICATING AND TOOTH STABILIZING SYSTEMS FOR EXCAVATING TOOTH AND ADAPTER ASSEMBLIES

[75] Inventor: Howard W. Robinson, Grapevine, Tex.

[73] Assignee: GH Hensley Industries, Inc., Dallas, Tex.

[21] Appl. No.: 510,285

[22] Filed: Apr. 16, 1990

[51] Int. Cl.[5] ..... E02F 9/28

[52] U.S. Cl. ..... 37/141 T; 37/DIG. 19; 37/142 R

[58] Field of Search ..... 37/141 R, 141 T, 142 R, 37/141 A, DIG. 19; 299/91

[56] References Cited

U.S. PATENT DOCUMENTS

| | | | |
|---|---|---|---|
| 1,095,605 | 5/1914 | Tipping . | |
| 1,330,143 | 2/1920 | Seal . | |
| 2,032,875 | 3/1936 | Graham | 37/142 |
| 2,360,315 | 10/1944 | Campbell et al. | 37/142 |
| 3,496,658 | 2/1970 | Eyolfson | 37/142 |
| 3,508,352 | 4/1970 | Radwill | 37/142 R |
| 3,736,676 | 6/1973 | Sturgeon | 37/142 R |
| 3,881,262 | 5/1975 | Cullen | 37/142 R |
| 3,897,642 | 8/1975 | Helton et al. | 37/142 R |
| 4,233,761 | 6/1980 | Ryerson | 37/142 R |
| 4,317,300 | 3/1982 | Emrich et al. | 37/142 R |
| 4,326,348 | 4/1982 | Emrich | 37/142 R |
| 4,407,081 | 10/1983 | Hanson | 37/141 T |
| 4,428,131 | 1/1984 | Hahn | 37/142 R |
| 4,587,751 | 5/1986 | Sjorgen et al. | 37/142 R |
| 4,716,667 | 1/1988 | Martin | 37/142 R |
| 4,965,945 | 10/1990 | Emrich | 37/142 R |
| 4,995,176 | 2/1991 | Briscoe et al. | 37/141 R |
| 5,005,304 | 4/1991 | Briscoe et al. | 37/141 R |

*Primary Examiner*—Randolph A. Reese
*Assistant Examiner*—Spencer Warnick
*Attorney, Agent, or Firm*—Hubbard, Thurman, Tucker & Harris

[57] ABSTRACT

An earthworking tooth point and adapter assembly is provided with a visual wear indicating system which permits tooth point use to be maximized without subjecting the adapter nose within the tooth point pocket to earth abrasion. The wear indicating system includes a pair of generally U-shaped ribs formed on a front end portion of the adapter nose and wrapping around its front end and top and bottom side surfaces. With the adapter nose operatively positioned within the tooth point pocket the ribs are received in complementarily configured, generally U-shaped wear indicating grooves formed in the interior surface of the pocket at its front. As the tooth point is used, its front end is worn away until small holes are created therein which open into front portions of the pocket grooves, thereby exposing the previously concealed adapter nose ribs to view. When the operator sees these small holes, and the rib portions which underlie them, he removes and replaces the tooth point before further tooth wear subjects the adapter nose proper to earth abrasion. In this manner, maximum tooth point life is achieved without causing premature wear and replacement of the adapter. In an alternate embodiment of the assembly, stabilizing ribs on a front end of the adapter nose are received in rear portions of similar wear indicating grooves and carry the transverse tooth load, under extreme operating conditions, to inhibit rapid wearing away of the front end of the adapter nose.

3 Claims, 3 Drawing Sheets

WEAR INDICATING AND TOOTH STABILIZING SYSTEMS FOR EXCAVATING TOOTH AND ADAPTER ASSEMBLIES

BACKGROUND OF THE INVENTION

The present invention relates generally to excavation apparatus, and more particularly relates to earthworking tooth and adapter assemblies.

Large excavating buckets, loading buckets and the like are typically provided with a series of teeth which are each formed from two primary parts—a relatively large adapter and a relatively small replaceable point. The adapter has a base portion which is connectable to the forward lower lip of the bucket and a nose portion onto which the tooth point is removably secured by a suitable connecting pin. Compared to that of the adapter, the useful life of the point is rather short—the adapter typically lasting through five ore more point replacements until the tremendous earth forces and abrasion to which it is subjected necessitates its replacement.

Because the much larger adapter is considerably more expensive than its smaller replaceable point, it is desirable to replace the point before it has been worn away to the extent that the nose portion of the adapter, disposed within a pocket in the rear end of the tooth, point, is exposed to earth abrasion and also worn away, thereby undesirably loosening the adapter/point fit when a new tooth point is installed on the adapter. On the other hand, it is also desirable not to prematurely replace a tooth point, still having a portion of its useful operating life left, simply to protect the nose portion of its associated adapter from earth abrasion. Such premature tooth point replacement, of course, can also significantly increase the overall expense associated with the particular excavation or loading process.

The proper economic balance is thus struck when the tooth point is replaced just prior to the time at which it wears through to its adapter nose. However, in practice, it is quite difficult to precisely determine this ideal tooth point replacement time, and considerable skill and experience are required to even approximate it because if the adapter nose becomes visible through a side wall portion of its associated tooth point it is usually too late to prevent earth abrasion wear on the adapter nose and the relatively expensive adapter must be prematurely replaced. Because there has heretofore been no reliable method for precisely determining the time at which the adapter nose is about to be exposed through a worn away portion of its tooth point, tooth points of this type are generally removed and replaced well before this tooth wear condition is reached.

Another problem also exists in conventional tooth and adapter assemblies and relates to the preservation of the necessary snug interfit between the adapter nose and the tooth point pocket which receives it. Under normal tooth operating load conditions, a flat top side surface of the tooth pocket bears against and is supported by a corresponding flat top side surface of the adapter nose, and this tooth-supporting force is fairly well distributed over the flat top side surface of the adapter nose.

However, under extreme operating loads the tooth point tends to bend forwardly and downwardly relative to the adapter nose. This undesirably concentrates the adapter nose/tooth engagement along the top front edge of the adapter nose, thereby substantially accelerating nose wear and loosening the critical nose/tooth fit. In turn, this often necessitates premature adapter replacement.

In view of the foregoing, it is accordingly an object of the present invention to provide tooth and adapter assembly apparatus which eliminates or minimizes the above-mentioned and other problems, limitations and disadvantages typically associated with conventional tooth and adapter assemblies.

SUMMARY OF THE INVENTION

In carrying out principles of the present invention, in accordance with an illustrative embodiment thereof, an excavating tooth and adapter assembly is provided with a wear indicating system which provides a reliable visual indication, before the adapter nose is subjected to direct earth abrasion wear, that the maximum operating life of the tooth has ended, thereby permitting the tooth point to be replaced just prior to the time at which the adapter nose would be subject to earth abrasion.

The wear indicating system, in a preferred embodiment thereof, comprises rib means which project outwardly from and extend along top and bottom sides, and the front end, of the adapter nose. These outwardly projecting rib means formed on the adapter nose are received within complementarily configured wear indicating groove means formed in an inner end portion of the adapter pocket which extends forwardly through the rear end of the replaceable tooth point and snugly receives the adapter nose, the tooth point and the adapter nose received therein being releasably intersecured by a suitable connecting pin structure.

As the tooth point is progressively worn away in a rearward direction, a point is reached at which the rib means become visible through one or more wear openings extending through the outer surface of the tooth point and overlying the adapter pocket grooves. When the rib means become visible in this manner, the worn away tooth point is replaced.

Importantly, while the now exteriorly visible rib means may have sustained some earth abrasion damage thereto, the nose portion of the relatively expensive adapter has not. Accordingly, by utilizing the wear indicating system of the present invention in this manner, the proper balance may be struck between obtaining the maximum useful operating life of the tooth point and protecting the much more expensive adapter against the need for premature replacement thereof.

In an alternate embodiment of the present invention, the adapter nose is provided, on its top and bottom sides adjacent its front end, with stabilizing ribs which are received in rear end portions of the wear indicating grooves. Under normal downwardly directed operating force conditions on the tooth/adapter assembly, the adapter nose supports the downward tooth load along a substantial portion of its upper side surface.

However, under extreme operating loads on the tooth, which tend to bend it forwardly and downwardly relative to the adapter nose, the downward tooth force is automatically transferred from the upper side surface of the adapter nose to the upper nose stabilizing ribs, until the tooth operating load returns to normal levels, to substantially prevent the usual line contact between the top front edge of the adapter nose and the upper side surface of the tooth pocket, and the inordinate nose wear resulting therefrom When the downward tooth operating load returns to normal levels the downward tooth load is automatically returned to the upper side surface of the adapter nose.

DETAILED DESCRIPTION

Figure 1:
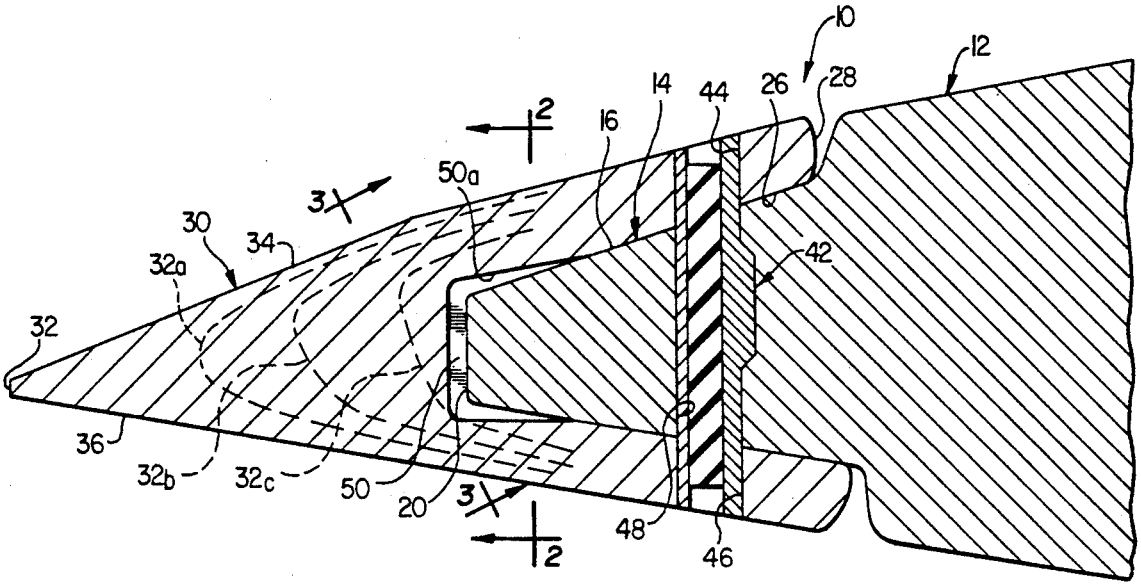
FIG. 1 is a somewhat simplified cross-sectional view through a front portion of an excavating tooth and adapter assembly in which a wear indicating system, embodying principles of the present invention, is incorporated.

Cross-sectionally illustrated in FIG. 1, in somewhat simplified form, is a front end portion of an excavating tooth and adapter assembly 10 which is utilized in a variety of large scale earth excavating or loading operations. The assembly 10 includes an adapter portion 12 which is suitably secured in a conventional manner to an excavating or loader bucket lip (not shown) or the like. Adapter 12 has a tapered forward nose portion 14 (see FIG. 4 also) having top and bottom side surfaces 16 and 18, a front end surface 20, and opposite left and right side surfaces 22 and 24 which collectively provide load bearing surfaces for ultimately supporting the point by loads transmitted from the replaceable tooth point 30 hereafter described.

The tapered adapter nose 14 is snugly received within a complementarily configured adapter load pocket 26 which extends forwardly through the rear end 28 of a tapered, replaceable tooth point 30 which, as illustrated in FIGS. 1–4, has a front end 32, downwardly and forwardly tapering top and bottom side surfaces 34 and 36, and opposite left and right side surfaces 38 and 40. Thus, a load pocket is defined by the load transmitting surfaces with the point 30 which are complimentary to (i.e., snugly mate with) the load bearing surfaces of the adapter nose so that loads applied to the tooth point during normal operation are transmitted through the load transmitting surfaces defining the load pocket in the tooth to the complementary load bearing surface of the nose. The adapter nose 14 is captively and releasably retained within the tooth load pocket 26 by means of a conventional resilient flex pin 42 (FIG. 1) which is driven into and through aligned top and bottom side openings 44 and 46 in the tooth point 30, and an opening 48 formed vertically through a horizontally intermediate portion of the adapter nose.

During excavation, loading or other earthworking use of the tooth and adapter assembly 10, the front or left end of the tooth point 30 becomes progressively worn away, in a rearward or rightward direction as viewed in FIG. 1, along progressive front end wear contour surfaces $32_a$, $32_b$ and $32_c$ (only three such contour surfaces being shown for illustrative purposes). As long as the particular front end wear contour surface is disposed outwardly of the front end 20 of the adapter nose 14, there is no direct earth abrasion wear on the adapter nose. However, as the resulting front end wear contour surface reaches the front end 20 of the adapter nose, the adapter nose begins to wear away.

This occurrence is highly undesireable because the adapter nose is much more expensive than the replaceable tooth point and if even a relatively small portion of the adapter nose is worn away, the stability of the adapter/tooth point connection is adversely affected and the entire adapter 12 must be prematurely discarded and replaced. It is accordingly desireable to replace the tooth point 30 before any abrasion wear occurs on the adapter nose 14.

In conventional tooth and adapter assemblies, proper timing of tooth point replacement, so that the point is replaced before direct earth abrasion wear of the adapter nose 14 begins, but without premature changeout of a still usable tooth point, is largely a matter of guesswork. If tooth points are replaced before their wear contour surfaces closely approach the tooth pocket 26, a particular earth working operation will use up more points than is necessary, thereby substantially increasing the overall cost of such operation. On the other hand, if a particular tooth point is allowed to wear through into the tooth pocket, the adapter usually must be prematurely replaced at an even larger expense. In conventional tooth and adapter assemblies, there is simply no way to precisely gauge the ideal time at which a tooth point should be removed and replaced without creating earth abrasion of the adapter and additionally without wasting a still useful portion of the worn away tooth point.

Figure 2:
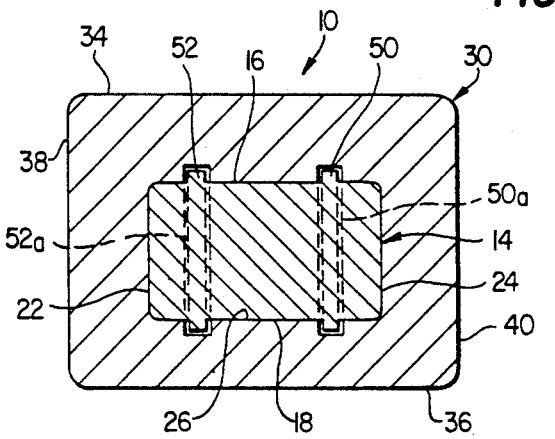
FIG. 2 is a cross-sectional view through the assembly taken along line 2—2 of FIG. 1.
Figure 4:
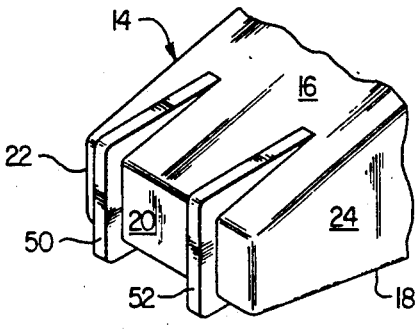
FIG. 4 is a perspective view of the adapter nose portion of the assembly removed from the tooth point pocket.

In the present invention, this problem is essentially eliminated, and the tooth point 30 may be removed and replaced at the very end of its useful life, but before the adapter nose 14 is subjected to earth abrasion, by the provision of a unique wear indicating system incorporated in the tooth and adapter assembly 10. Referring now to FIGS. 1, 2 and 4, the wear indicating system includes a pair of generally U-shaped ribs 50 and 52 formed on the front end of the adapter nose 14. As illustrated, the ribs 50 and 52 project outwardly from the adapter nose 14, are respectively positioned adjacent its opposite side surfaces 22 and 24, and wrap around the upper side surface 16, the front end surface 20, and the bottom side surface 18 of a front end portion of the adapter nose 14.

The wear indicating system of the present invention also includes a pair of generally U-shaped wear indicating grooves $50_a$ and $52_a$ formed in the interior surface of a front or left end portion of the tooth pocket 26. With the adapter nose 14 operatively received in the pocket 26, and captively retained therein by the flex pin 42, the wear ribs 50, 52 are respectively and complementarily received in the grooves $50_a$ and $52_a$.

Figure 3:
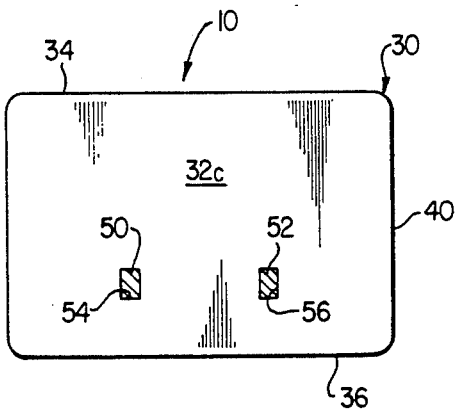
FIG. 3 is a front end elevational view of the tooth point portion of the assembly, after the tooth point has been rearwardly worn away, and illustrates the visual indication, given by the wear indicating system, that the time for tooth point replacement has been reached.

Referring now to FIGS. 1 and 3, as the front end of the tooth point 30 is progressively worn away in a rearward direction, to wear contour surface $32_c$ shown in FIG. 1, the tooth point wear contour surface $32_c$ intersects the boundaries of the wear indicating grooves $50_a$ and $52_a$, thereby creating small openings 54 and 56 (FIG. 3) in the worn away front end surface $32_c$ of the tooth point and exposing to view front portions of the wear indicating ribs 50 and 52 as shown in FIG. 3.

As soon as these portions of the ribs 50, 52 are visible at the front end of the worn away tooth, through the resulting tooth point openings 54 and 56, the operator simply removes the worn tooth point and replaces it with a new one.

Quite importantly, while there may be some minor earth abrasion to the ribs 50 and 52, which function to impede tooth point abrasion wear across the grooves $50_a$ and $52_a$ toward the adapter nose, the earth abrasion has not yet reached a front end portion of the adapter nose proper. Accordingly, the interlock stability between the adapter nose and a subsequent tooth point has not been adversely affected. Thus, the maximum operating life of the tooth point 30 has been achieved without jeopardizing the adapter 12 and requiring it to be prematurely replaced.

The wear indicating system just described is easy and quite inexpensive to incorporate in a tooth and adapter assembly, and gives a highly reliable visual indication that the optimum time for tooth point replacement has arrived. Simply stated, all an operator has to do is periodically look at the front end of the tooth point and, when he first sees small portions of the ribs 50 and 52, remove the tooth point and replace it.

While the illustrated tooth point 30 is an excavating tooth, it will readily be appreciated that the visual wear indicating principles of the present invention may also be utilized in conjunction with tooth and adapter assemblies using other types of teeth including, but not limited to, loader teeth, ripper teeth, dipper teeth and the like which may be hereinafter referred to generically as "earthworking teeth".

Figure 5:
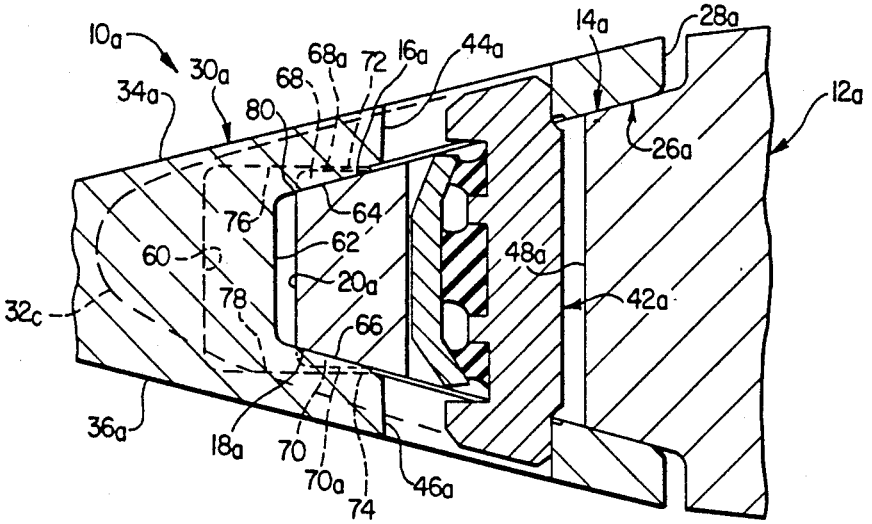
FIG. 5 is a horizontally foreshortened cross-sectional view through an alternate embodiment of the excavating tooth and adapter assembly.
Figure 6:
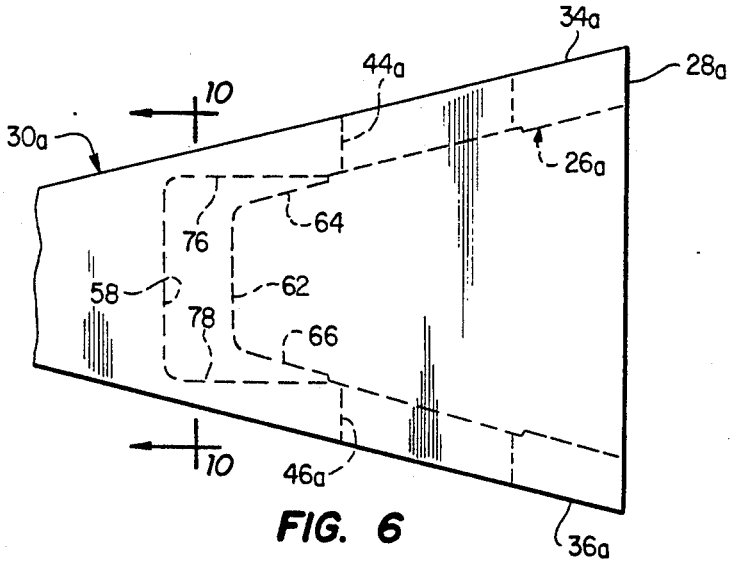
FIG. 6 is a side elevational view of the tooth point portion of the FIG. 5 assembly.
Figure 7:
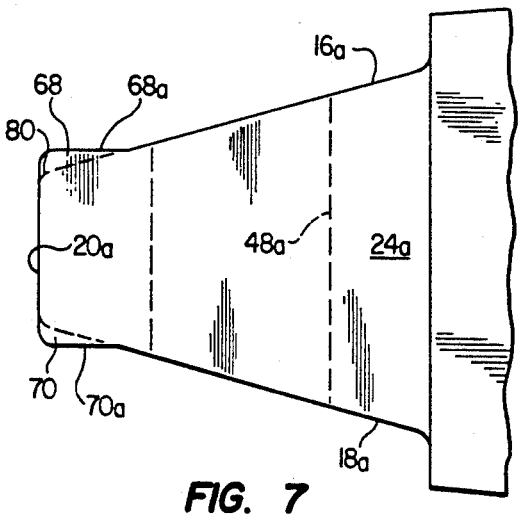
FIG. 7 is a side elevational view of the adapter nose portion of the FIG. 5 assembly.
Figure 8:
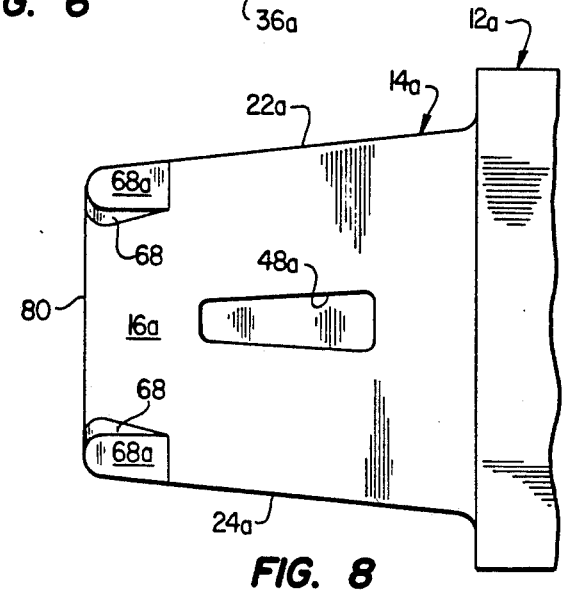
FIG. 8 is a top plan view of the adapter nose portion of the FIG. 5 assembly.
Figure 9:
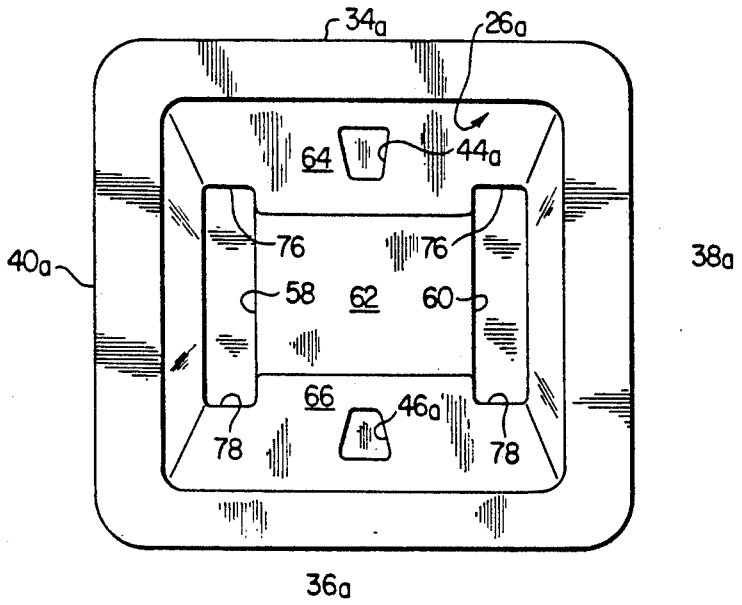
FIG. 9 is a front end elevational view of the adapter nose portion of the FIG. 5 assembly.
Figure 10:
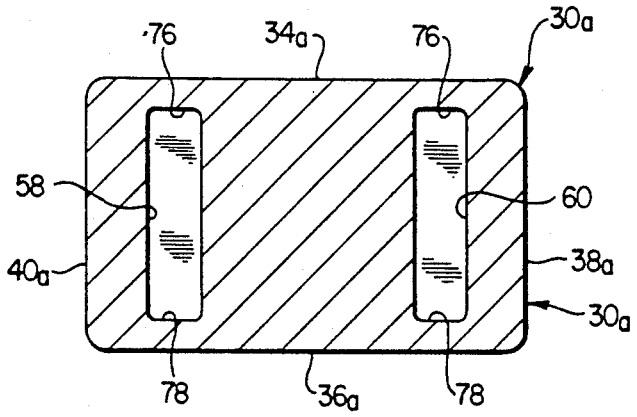
FIG. 10 is a cross-sectional view through the adapter nose portion of the FIG. 5 assembly taken along line 10—10 of FIG. 6.

Cross-sectionally illustrated in FIG. 5 is an alternate embodiment $10_a$ of the tooth and adapter assembly 10. Parts in the assembly $10_a$ which are similar to those of assembly 10 have been given identical reference numberals, but with the subscripts "a". As illstrated in FIGS. 5, 6, 9 and 10, the tooth point $30_a$ is provided with a pair of rectangularly cross-sectioned wear indicating grooves 58 and 60 which extend forwardly into the tooth point past the front end 62 of its pocket $26_a$ on horizontally opposite sides of the pocket, the grooves 58 and 60 extending rearwardly along top and bottom sides 64 and 66 of the pocket $26_a$.

Formed on opposite sides of the top and bottom adapter nose surfaces $16_a$ and $18_a$ are small stabilizing ribs 68 and 70 having flat top and bottom sides $68_a$ and $70_a$. As illustrated in FIG. 5, these stabilizing ribs 68 and 70 are received within rear portions of the wear indicating grooves 58 and 60, with small clearance spaces 72 and 74 being defined between the ribs 68, 70 and the top and bottom side surfaces 76, 78 of the grooves 58 and 60.

Under normal operating conditions, the downward forces on the tooth point $30_a$ bring the upper side surface 64 of the tooth pocket into forcible contact with the essentially flat upper side surface $16_a$ of the adapter nose $14_a$ in a generally uniform fashion across its area. However, when extreme, temporary downward operating forces are imposed upon the tooth point $30_a$ such forces tend to bend it in a counterclockwise direction relative to the adapter nose $14_a$. In conventional tooth and adapter assemblies, this counterclockwise bending of the tooth point would concentrate the downward tooth point forces on the top front edge 80 of the adapter nose, thereby undesirably wearing it away and loosening the critical adapter nose/tooth point fit in the overall assembly.

In the present invention, however, the upper stabilizing ribs 68 function to automatically engage the upper side surfaces 76 of the wear indicating grooves 58 and 60, thereby transferring the downward tooth force from the upper side surface $16_a$ of the adapter nose to the upper side surfaces $68_a$ of the top stabilizing ribs 68. This essentially prevents the undesireable shifting, under extreme operating conditions, of the downward tooth point force to the top front edge 80 of the adapter nose. When the operating force on the tooth point $30_a$ returns to normal levels, the downward tooth force is automatically returned to the upper side surface $16_a$ of the adapter nose $14_a$. In this manner inordinate wear, and the necessity for premature adapter replacement, are uniquely eliminated in the present invention. It will be appreciated that the lower stabilizing ribs 70 will serve this same tooth load transfer function in the event that the tooth point $30_a$ is subjected to a clockwise bending by temporary extreme operating forces thereon.

Figure 11:
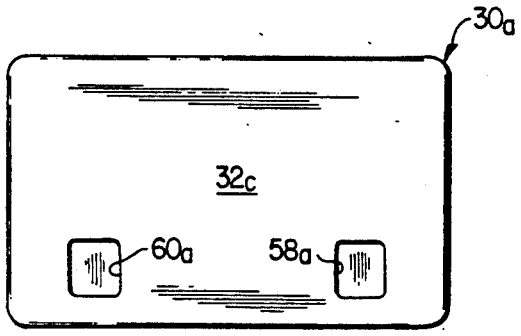
FIG. 11 is a front end elevational view of the tooth point portion of the FIG. 5 assembly after the tooth point has been rearwardly worn away to an extent requiring its replacement.

The wear indicating grooves 58, 60 in the alternate embodiment $10_a$ of the tooth and adapter assembly 10 function in a manner identical to that previously described in conjunction with FIG. 3. Specifically, when the tooth point $30_a$ is worn away to the wear contour surface $32_c$ shown in FIG. 5, a pair of small openings $58_a$, $60_a$ (FIG. 11) become visible on the worn away front end of the tooth $30_a$. As previously described, these openings signal the operator that the tooth $30_a$ has reached the end of its useful operating life and needs to be replaced. As in the case of the previously described tooth and adapter assembly 10, the adapter nose $14_a$ is subjected to direct earth abrasion wear.

The foregoing detailed description is to be clearly understood as being given by way of illustration and example only, the spirit and scope of the present invention being limited solely by the appended claims.

What is claimed is:

1. A tooth assembly for an earth working implement comprising a generally elongated adapter attached at one end to the implement and having a wear point supporting nose at the other end, a generally elongated integrally cast metal wear point having an earth penetrating surface at one end and an interior cavity for receiving the nose of the adapter at the other end, the nose including primary load bearing surfaces for bearing, during normal operation, thrust loads imposed axially on the earth penetrating surface of the point, upwardly and downwardly directed bending loads imposed on the point, and side loads imposed on the point, the load bearing surfaces substantially defining the exterior surface of the nose, the wear point including load transmitting surfaces within the cavity mating with each of the load bearing surfaces on the nose during normal earth working operations, these load transmitting surfaces defining a load pocket within the cavity of the wear point corresponding essentially to the exterior surface of the nose, the tooth assembly being mounted on the implement such that a normal wear surface progresses during use from the earth penetrating surface toward and would eventually intersect the load transmitting surfaces of the load pocket and thereby wear one or more primary load bearing surfaces on the adapter nose if the wear point is not replaced, and wear indicating means including at least one cavity formed within the metal of the wear point and extending from the load pocket towards the wear surface which is intersected by the progressing wear surface substantially before the wear surface intersects the load pocket and a mating load bearing surface and provides a visual indication of the state of wear point so that the wear point can be replaced before the load bearing surfaces are damaged by further wear.

2. The tooth assembly of claim 1 further characterized by wear indicating means formed on the adapter nose and projecting beyond the load bearing surfaces and the load pocket into the wear indicating cavity means of the wear point for assisting in indicating the degree of wear of the wear point.

3. A war point for a tooth assembly of an earth working implement having a generally elongated adaptor attached at one end to the implement and having a wear point supporting nose at the other end for supporting a wear point having an earth penetrating surface at one end and an interior cavity for receiving the nose of the adaptor at the other end, the nose including primary load bearing surfaces for bearing thrust loads imposed axially on the earth penetrating surface of the wear point, upwardly and downwardly directed bending loads imposed on the wear point, and side loads imposed on the wear point, the load bearing surface substantially defining the exterior surface of the nose, the wear point comprising:

a generally elongaged integral metallic body defined by an exterior surface including an earth penetrating wear surface at one end and an interior cavity for receiving the nose of the adapter at the other end, the wear point including load transmitting surfaces within the cavity mating with each of the load bearing surfaces on the nose during normal earth working operations, these load transmitting surfaces defining a load pocket within the cavity of the wear point corresponding essentially to the exterior surface of the nose, the wear point being mountable on the nose such that a normal wear surface progresses during use from the earth penetrating surface toward and would eventually intersect the load transmitting surfaces of the load pocket and wear one or more primary load bearing surfaces on the adaptor nose if the wear point is not replaced, and wear indicating means including at least one cavity formed within the wear point and extending from the load pocket towards the wear surface which is intersected by the progressing wear surface substantially before the progressing wear surface intersects the load pocket and one or more of the mating load bearing surfaces and provides an externally visible indication of the state of wear of the wear point so that the wear point can be replaced before the load bearing surfaces of the nose are damaged by further wear.

* * * * *